United States Patent [19]

Daugherty

[11] Patent Number: 4,489,649

[45] Date of Patent: Dec. 25, 1984

[54] CAN COMPACTER

[76] Inventor: Donald H. Daugherty, 10325 N. Government Way, Hayden Lake, Id. 83835

[21] Appl. No.: 547,127

[22] Filed: Oct. 31, 1983

[51] Int. Cl.[3] ..... B30B 9/32

[52] U.S. Cl. ..... 100/215; 100/256; 100/269 R; 100/902

[58] Field of Search ..... 100/902, 215, 216, 245, 100/256, 269 R; 241/99

[56] References Cited

U.S. PATENT DOCUMENTS

| | | | |
|---|---|---|---|
| 3,412,675 | 11/1968 | Killough | 100/256 X |
| 3,583,011 | 6/1971 | Maurer | 100/245 X |
| 3,916,780 | 11/1975 | Heiser | 100/902 X |
| 3,976,002 | 8/1976 | Gerlach | 100/902 X |
| 4,013,181 | 3/1977 | Johnson | 100/245 X |

FOREIGN PATENT DOCUMENTS

| | | | |
|---|---|---|---|
| 1570205 | 6/1969 | France | 100/245 |

*Primary Examiner*—Billy J. Wilhite

[57] ABSTRACT

A can compacter assembly comprising a motor, a fluid pump driven by the motor, a fluid cylinder operatively connected to the fluid pump, a piston movably disposed in the fluid cylinder, a plunger connected to the piston and disposed outside the fluid cylinder but slidably within a plunger slide assembly, and a cradle disposed adjacent the plunger slide assembly, the cradle being adapted to receive a can and being further adapted to receive the plunger, whereby the plunger is adapted to exercise a compressive force against the can to compact the can.

5 Claims, 9 Drawing Figures

CAN COMPACTER

FIELD OF THE INVENTION

This invention relates to compacting machines and is directed more particularly to a can compacter adapted to compact one can at a time and suitable for home use.

SUMMARY OF THE INVENTION

An object of the invention is to provide a safe, reliable and economical can compacter, taking up a minimum of space and adapted for home use.

With the above and other objects in view, as will hereinafter appear, a feature of the present invention is the provision of a can compacter assembly comprising a motor, a fluid pump driven by the motor, a fluid cylinder operatively connected to the fluid pump, a piston movably disposed in the fluid cylinder, a plunger connected to the piston and disposed outside the fluid cylinder, a plunger slide assembly, the plunger being slidably disposed in the plunger slide assembly, and a cradle disposed adjacent the plunger slide assembly, the cradle being adapted to receive a can and being further adapted to receive the plunger, whereby the plunger is adapted to exercise a compressive force upon the can to compact the can.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
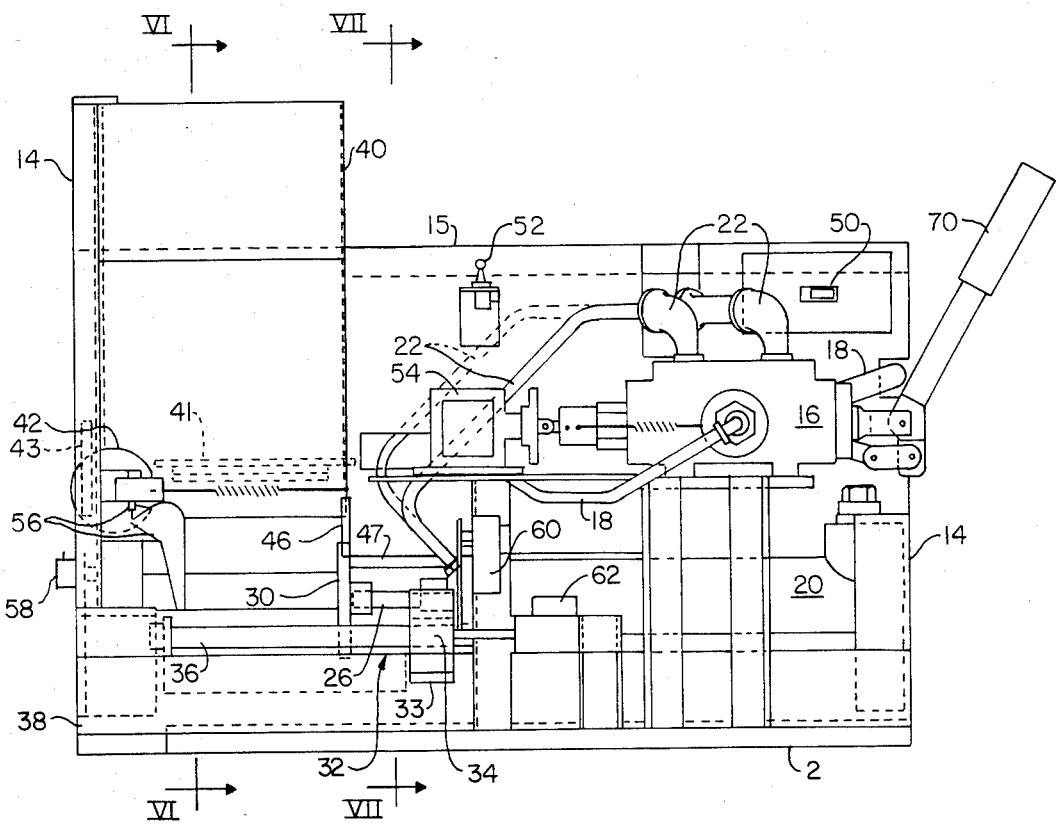
FIG. 1 is a front elevational view of a compacter assembly, illustrative of an embodiment of the invention.
Figure 2:
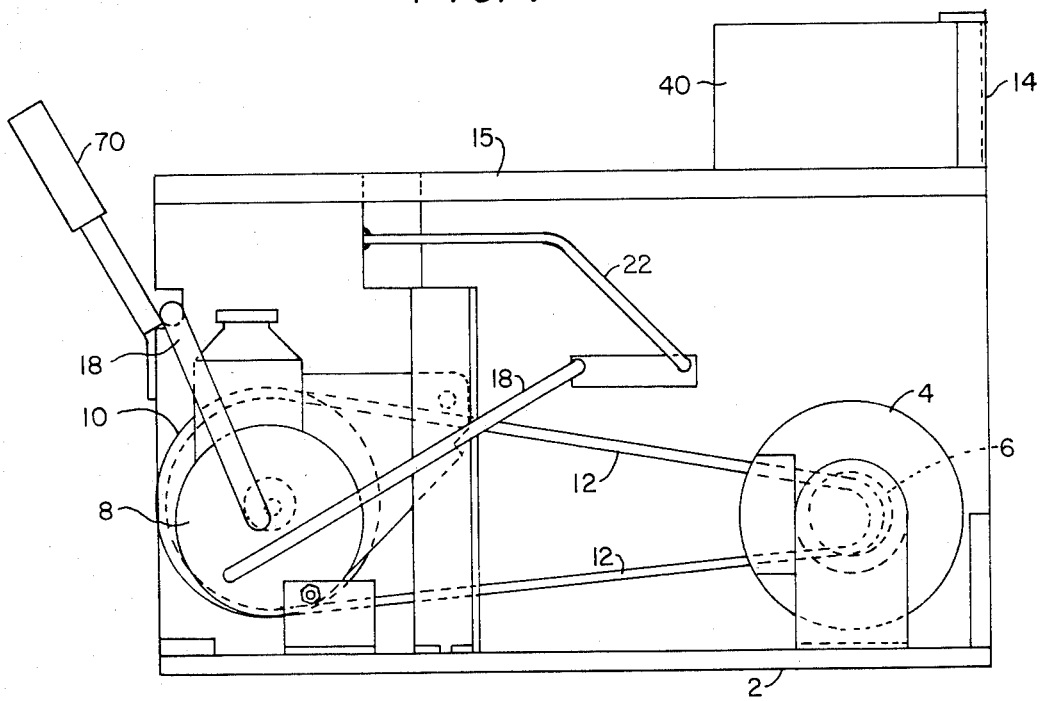
FIG. 2 is a back elevational view thereof.

Referring to the drawings, it will be seen that the illustrative embodiment of the invention includes a base portion 2 adapted for mounting on a table, counter, shelf, or the like. Mounted on the base portion 2 is an electric motor 4 operative to rotate a drive wheel 6 attached thereto. Also mounted on the base portion 2 is a hydraulic pump 8 having fixed thereto a drive wheel 10 which is connected to the drive wheel 6 by an endless belt 12.

A frame portion 14, including a wall portion 15, upstands from the base portion 2 and has mounted thereon a hydraulic control valve 16 connected to the hydraulic pump by hydraulic hoses 18.

Figure 9:
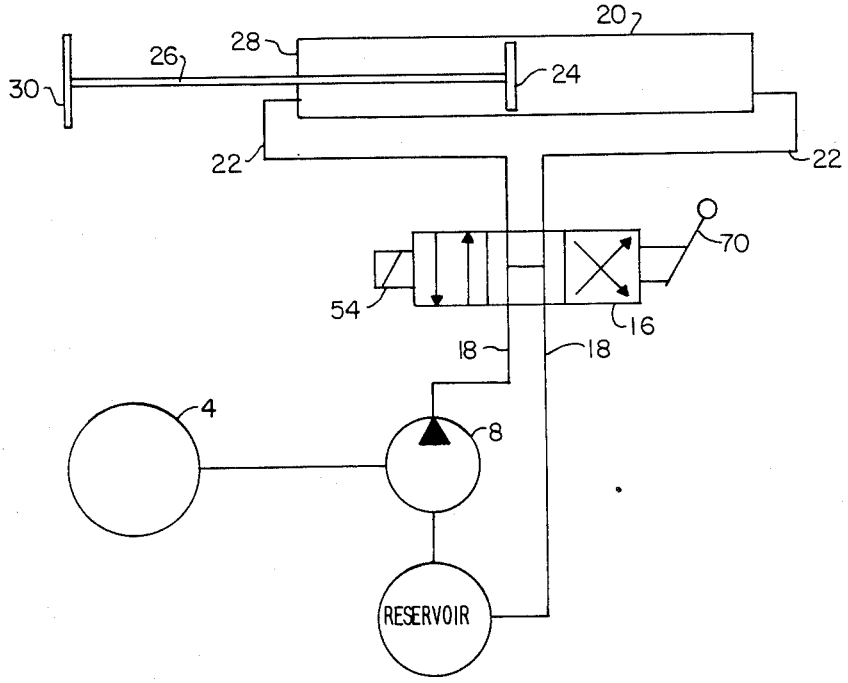
FIG. 9 is a diagrammatic representation of the hydraulic circuitry of the assembly.

A hydraulic cylinder 20 is mounted on the frame portion 14 and is operatively connected to the hydraulic control valve 16 (FIGS. 1, 4 and 5) by hydraulic cylinder hoses 22. A piston 24 (FIG. 9) is movably disposed in the cylinder 20 and is caused to move therein by hydraulic pressure thereagainst responsive to the operation of the hydraulic control valve 16. A piston rod 26 extends from the piston 24 and through an opening in one end 28 of the cylinder 20. A plunger 30 is fixed to the free end of the piston rod 26 (FIGS. 1, 3, 5 and 6).

Figure 5:
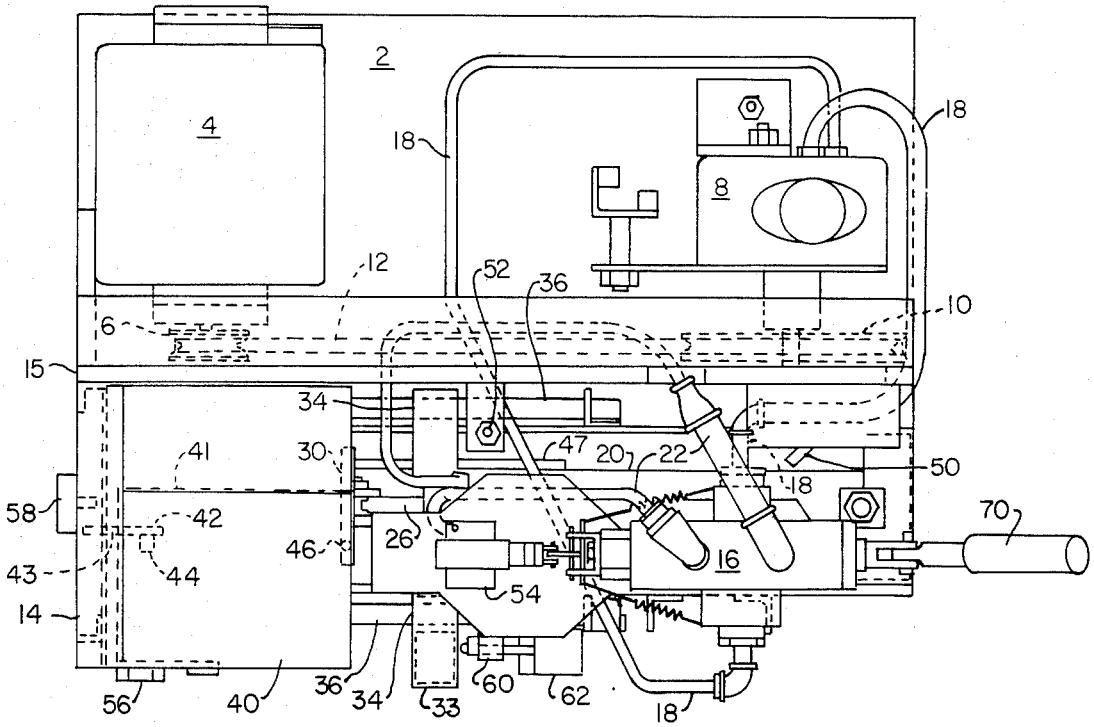
FIG. 5 is a top plan view thereof.
Figure 7:
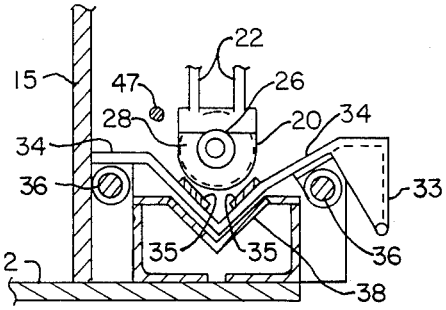
FIG. 7 is a sectional view of a portion of the assembly, taken along line VII—VII of FIG. 1.
Figure 8:
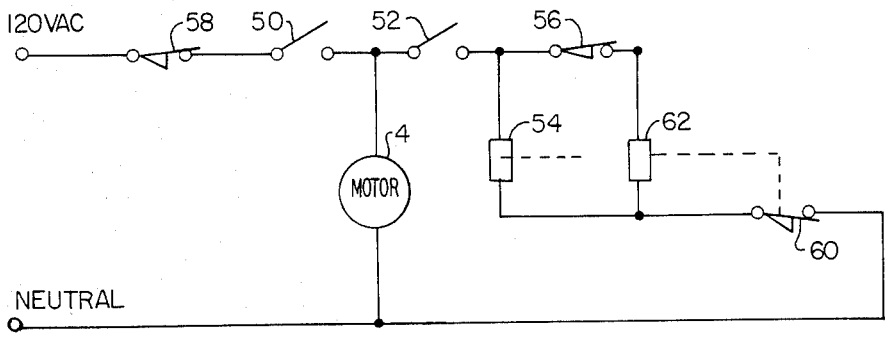
FIG. 8 is a diagrammatic representation of the electrical circuitry of the assembly.

A plunger slide assembly 32, including a pair of slide rods 36, is mounted on the frame portion 14 and has slidably mounted thereon the plunger 30. Struts 34 are connected to the rearward face of the plunger 30 by legs 35 (FIG. 7) and extend outwardly on either side from the plunger 30, and are slidably mounted on the slide rods 36 (FIGS. 1, 5 and 7).

Figure 3:
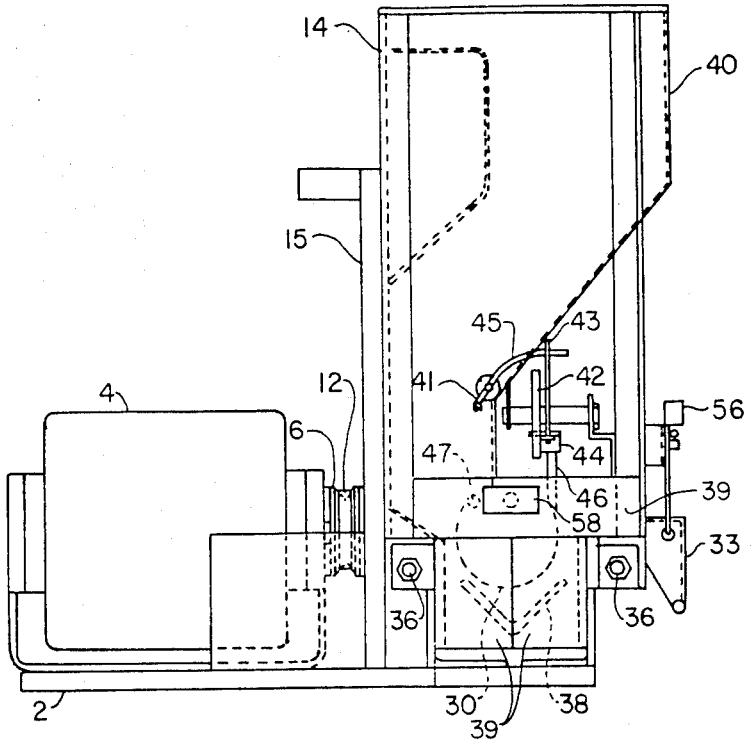
FIG. 3 is a right side elevational view thereof.
Figure 4:
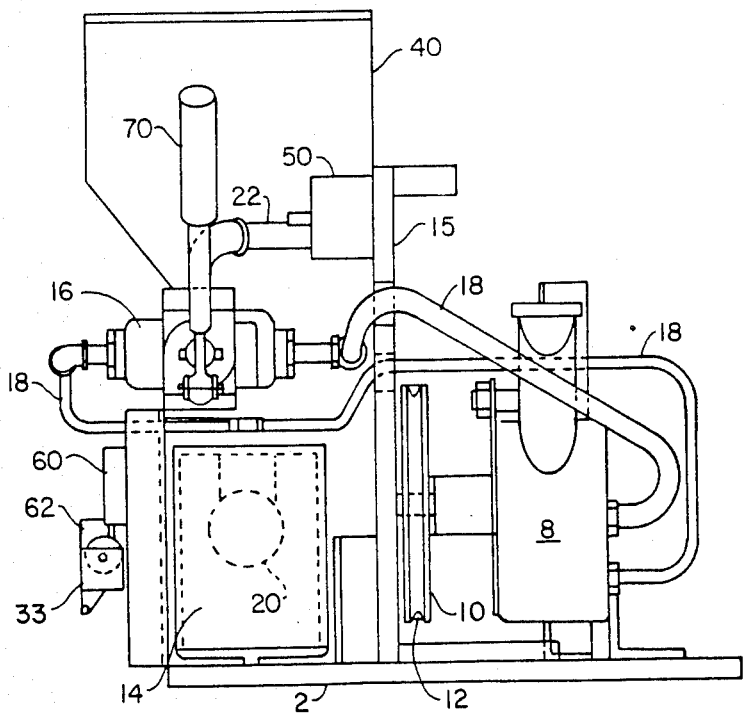
FIG. 4 is a left side elevational view thereof.
Figure 6:
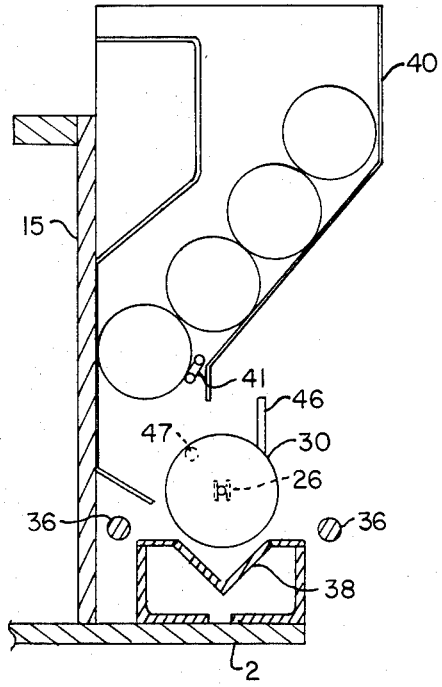
FIG. 6 is a sectional view of a portion of the assembly, taken along line VI—VI of FIG. 1.

A can cradle 38 (FIGS. 1, 3, 6 and 7) is mounted on the base portion 2 and is adapted to receive a can, and is also adapted to receive the plunger 30 in a manner facilitating compaction of the can in the cradle by the plunger. A stationary platen 39 is mounted on the frame portion 14 (FIG. 3). The platen 39 may comprise a plurality of steel members welded together, as illustrated in FIG. 3, or a single steel member. A hopper 40 may be located proximate the cradle 38 to receive empty cans and feed them one at a time to the cradle (FIG. 6).

The hopper 40 is provided with a trap door 41 (FIGS. 1, 3 and 6) near the bottom thereof, through which a can may move to the cradle 38. A rotatable wheel 42 (FIGS. 1, 3 and 5), having a pin fixed thereto, is positioned proximate the trap door 41, the wheel 42 being spring biased to a position in which the distal end of the pin 43 is connected to an extension 45 (FIG. 3) of the trap door 41. The wheel 42 is provided with a protruberance 44 extending from a face thereof. The plunger 30 has extending therefrom a dog 46 (FIGS. 1, 3, 5 and 6) which is adapted to engage the protruberance 44 during a compressive stroke. Engagement of the dog 46 with the protruberance 44 forces the wheel 42 to rotate such as to move the pin 43, and therefore the trap door extension 45, and the trap door 41, causing the door 41, which is hingedly mounted, to tilt, so as to permit a can to pass through the bottom of the hopper, entry into the cradle 38 being blocked by the presence of a rod 47 (FIGS. 1, 3, 5, 6 and 7) extending rearwardly from the rearward face of the plunger 30. Upon withdrawal of the plunger and the rod 47, the can falls into the cradle, the spring-biased wheel 42 returns to its at-rest position, and the trap door 41 returns to its closed position.

An "off-on" electrical switch 50 (FIGS. 1, 4 and 5) may be mounted on the frame portion 14, and is operative to run the electric motor 4, and thereby the hydraulic pump 8. An "automatic" electrical switch 52 (FIGS. 1 and 5) may be mounted on the frame portion and is turned to the "on" position if automatic operation of the machine is desired. If hand operation is desired, the switch 52 is turned to the "off" position. Hand, or manual, operation of the assembly will be described below.

A control valve switch 54 (FIGS. 1 and 5) may be mounted on the frame portion 14 and is operative to cause movement of the piston 24 in forward, or compacting, and reverse directions. The control valve switch 54 is spring or magnetic biased to return to the "reverse" position upon breaking of the compaction circuit.

Mounted on the frame portion, preferably proximate the plunger slide assembly, is a return switch 56 (FIGS. 1, 3 and 5) activated by contact with a plunger guide block 33 mounted on one of the struts 34, to break the compaction circuit, which causes the spring-biased hydraulic control valve switch 54 to reverse the hydraulic control valve 16, thereby withdrawing the plunger 30 from the cradle area.

A shut-down switch 58 (FIGS. 1, 3 and 5) may be mounted in the cradle 38 to close down the system when a can falls cross-wise into the cradle.

Mounted on the plunger slide assembly 32 is an "on" switch 60 (FIGS. 1, 4 and 5), which is operated by the plunger guide block 33, upon completion of a reverse stroke, to initiate return of the hydraulic control valve switch 54 to a "forward" or compressive stroke position, to start another cycle of operation. Another switch 62, similarly located as the switch 60, holds the switch 60 in the closed position until the guide block strikes the return switch 56 at the end of a forward, or compressive movement of the plunger.

In automatic operation, an operator turns the switch 50 to the "on" position, starting the motor 4, which causes rotation of the drive wheel 6 and, through the belt 12, rotation of the drive wheel 10, which in turn energizes the hydraulic pump 8. The hydraulic control valve 16 receives hydraulic fluid from the pump 8 by way of appropriate hydraulic hose 18 and directs hydraulic fluid, by way of the appropriate hydraulic cylinder hose 22, to the hydraulic cylinder 20.

The piston 24 may, for illustrative purposes, be at its rearwardmost position, with the guide block 33 having closed the "on" switch 60, and also closed the switch 62, operating to hold the switch 60 in the "on" position. The switch 60 has also operated to place the control valve switch 54 in the forward position. Thus, the switching arrangement is such that the fluid pressure in the cylinder 20 upon the piston 24 causes compressive stroke movement of the piston 24, piston rod 26, and plunger 30, the latter supported by the struts 34 and moving upon the plunger slide assembly 32. The plunger 30 moves forward, operating the hopper trip means, as above described to release a can from the hopper 40, the plunger 30 continuing movement into the receptacle area 38 where it compresses a can therein which has fallen from the hopper 40 and which, after being compressed against the platen 39, drops into a receptacle.

At completion of the compressive stroke, the guide block 33 opens the return switch 56 causing an interruption in the circuit, and opening of the switches 60, 62. Upon opening of the switch 60, the control valve switch 54 moves to a "reverse" position, reversing operation of the hydraulic cylinder 20 to start the reverse stroke and, thereafter, a new compressive stroke.

Alternatively, the operator may move the "automatic" switch 52 to "manual". In the manual mode, the hydraulic control valve is operated by a lever 70, which is moved to a first position to facilitate a compressive stroke and to a second position to facilitate a reverse stroke.

It is to be understood that the present invention is by no means limited to the particular construction herein disclosed and/or shown in the drawings, but also comprises any modifications or equivalents within the scope of the disclosure.

For example, as a space saving measure, it may in many instances be desirable to locate the motor and the hydraulic pump in an area removed from the remainder of the assembly.

Having thus described my invention, what I claim as new and desire to secure by Letters Patent of the United States is:

1. A can compacter assembly comprising a motor, a fluid pump operatively connected to said motor and adapted to be driven by said motor, a frame member, a stationary platen mounted on said frame member, a fluid control valve mounted on said frame member and in communication with said fluid pump, a fluid cylinder mounted on said frame member and in operative communication with said control valve, a piston movably disposed in said cylinder, a stem extending from said piston and through one end of said cylinder and having at its free end a plunger portion, a plunger slide assembly mounted on said frame member, said plunger portion being slidably disposed on said plunger slide assembly, a cradle mounted on said frame member and disposed adjacent to and in alignment with said plunger slide assembly and said platen, said cradle being adapted to receive a can and being further adapted to receive said plunger portion, whereby said plunger portion is adapted to compress said can against said platen is compact said can, a hopper mounted on said assembly and disposed proximate said cradle and adapted to feed cans serially into said cradle, a mechanical linkage between said plunger portion and said hopper, said mechanical linkage comprising a hingedly mounted trap door in said hopper, a rotatable spring-biased wheel proximate said hopper, a pin fixed to said wheel and having a distal end connected to said trap door, a protuberance extending from said wheel, and a dog extending from said plunger portion and adapted to engage said protuberance during a compressive stroke of said plunger portion, said engagement causing rotative movement of said wheel against said spring bias to cause said distal end of said pin to move said trap door hingedly to an open position, thereby permitting movement of a can from said hopper toward said cradle.

2. The can compactor in accordance with claim 1 including struts extending from said plunger portion, said struts being slidably mounted, at their ends remote from said plunger portion, on said slide assembly.

3. The can compacter in accordance with claim 1 including a lever mounted thereon and a switch means, said fluid control valve being alternatively operable by said lever or by said switch means.

4. The can compacter in accordance with claim 1 including a rod extending rearwardly from a rearward face of said plunger portion, said rod being operative to block entrance of said can in said cradle when said plunger portion is in a compressive position, rearward movement of said plunger portion and said rod operating to remove said rod as an impediment to the entrance of said can into said cradle.

5. The can compacter in accordance with claim 2 in which said slide assembly comprises a pair of slide rods mounted one on either side of said stem, and said struts include a pair of struts, each strut extending from said plunger portion and being slidably mounted on one of said rods, a plunger guide block extending from one of said struts and moveable therewith, electrical switch means mounted in the path of said guide block and engageable by said guide block at the ends of compressive and return strokes of said plunger portion, said electrical switches being operative at the end of a compressive stroke to initiate a return stroke and at the end of a return stroke to initiate a compressive stroke.

* * * * *